US005570796A

United States Patent [19]

Brown et al.

[11] Patent Number: 5,570,796

[45] Date of Patent: Nov. 5, 1996

[54] NURSING BOTTLE WITH AN AIR VENTING STRUCTURE

[76] Inventors: Craig E. Brown, 623 Antler Dr., Mt. Zion, Ill. 62549; Robert J. Brown, R.R. 1, Bonne Terre, Mo. 63628

[21] Appl. No.: 511,590

[22] Filed: Aug. 4, 1995

[51] Int. Cl.[6] ..... A61J 9/04

[52] U.S. Cl. ..... 215/11.5; 215/11.1; 215/902; 220/DIG. 27

[58] Field of Search ..... 215/11.1, 11.4, 215/11.5, 6, 902; 222/188; 220/DIG. 27

[56] References Cited

U.S. PATENT DOCUMENTS

| | | | |
|---|---|---|---|
| 345,518 | 7/1886 | Lelievre | 215/11.1 |
| 598,231 | 2/1898 | Roderick | 215/11.5 |
| 679,144 | 7/1901 | Hardesty | 222/188 X |
| 927,013 | 7/1909 | Van Cleave | 215/11.5 |
| 979,607 | 12/1910 | Van Cleve . | |
| 1,600,804 | 9/1926 | Donaldson | 215/11.1 |
| 2,156,313 | 5/1939 | Schwab | 222/188 X |
| 2,239,275 | 4/1941 | Schwab | 222/188 X |
| 2,742,168 | 4/1956 | Panetti | 215/11.4 |
| 2,744,646 | 5/1956 | Blackstone | 215/11.1 |
| 3,254,809 | 6/1966 | Breneman | 222/442 |
| 5,054,660 | 10/1991 | Sherman et al. | 222/454 |
| 5,269,444 | 12/1993 | Wright | 222/190 |

*Primary Examiner*—Sue A. Weaver
*Attorney, Agent, or Firm*—Armstrong, Teasdale, Schlafly & Davis

[57] ABSTRACT

A nursing bottle's interior remains at atmospheric pressure during use so a baby nursing from it is not forced to suck so hard that air is inadvertently swallowed. The nursing bottle has a container adapted to contain liquid at its bottom and having an air space at its top with a first opening at its top for the reception of a nipple cap, a reservoir located adjacent to the air space at the top of the container, a vertical liquid conduit from the bottom of the container to the bottom of the reservoir, and an air conduit from outside the bottle to a point in the reservoir where an air space exists when the bottle is filled with liquid and inverted. The reservoir has a volume greater than the volume of the liquid conduit and has a shape which slopes downwardly to the point of communication with the conduit so that any liquid in the reservoir drains out of the reservoir when the bottle is in the upright position and is retained in the reservoir when the bottle is in the inverted position. When liquid is added to the nursing bottle and the nursing bottle is fitted with a nipple, the liquid level in the container and in the conduit are the same. Furthermore, when the nursing bottle is inverted, the liquid from the liquid conduit flows into the reservoir and an open air passage is established through the air conduit-reservoir-liquid conduit to carry ambient air into the container.

10 Claims, 4 Drawing Sheets

FIG. 3
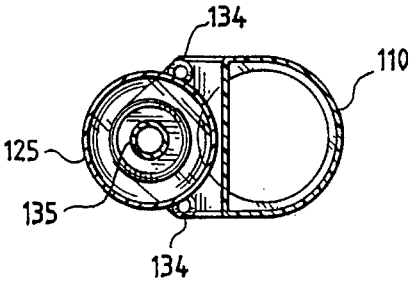
FIG. 4
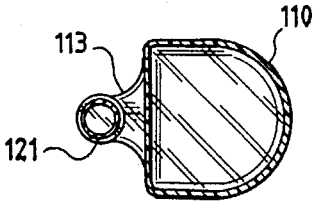
FIG. 2
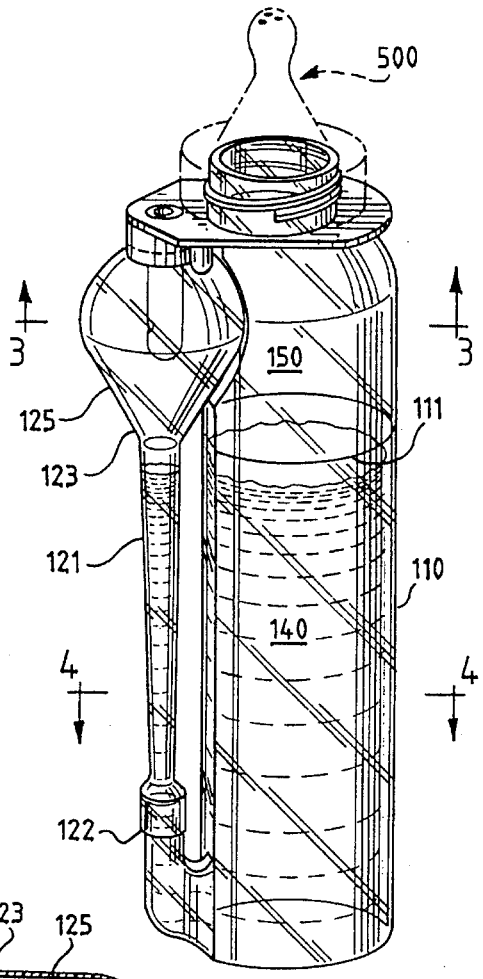
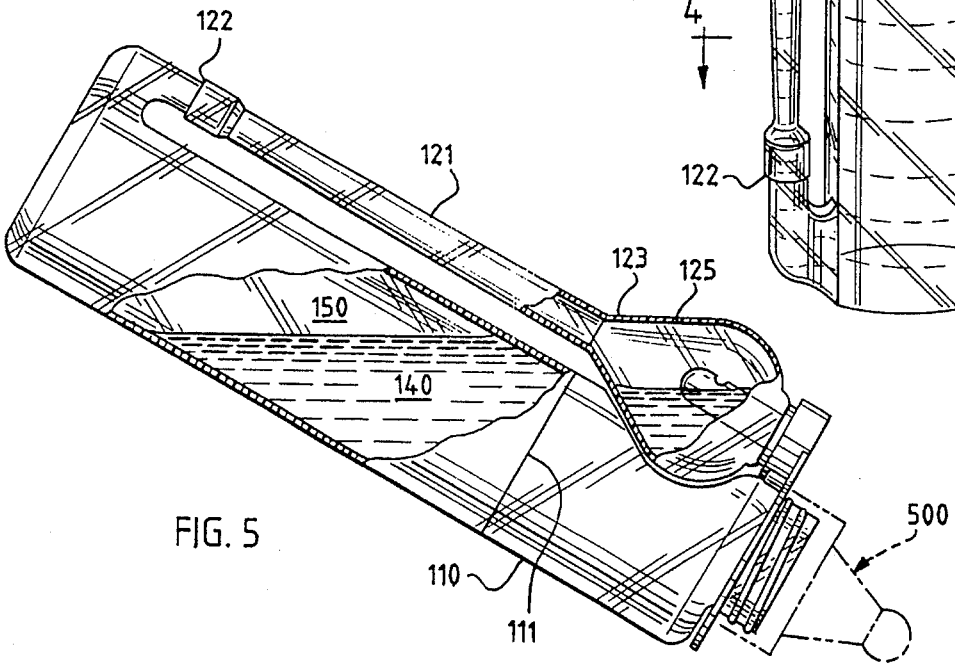
FIG. 5

NURSING BOTTLE WITH AN AIR VENTING STRUCTURE

FIELD OF THE INVENTION

This invention relates to nursing bottles. More particularly, this invention relates to nursing bottles having an air vent to maintain the interior of the bottle at atmospheric pressure during use.

BACKGROUND OF THE INVENTION

Babies are born with the instinct to suckle milk from their mothers' breasts, but it is often necessary for them to drink liquids from other sources. Babies are unable to drink liquids from glasses or cups without spilling so it is common throughout the world to feed liquids to babies in nursing bottles, also known as baby bottles. A nursing bottle features a rubber nipple with a small hole in its tip secured across an opening in the top of a liquid container. A nursing bottle is used by filling the container with liquid, securing the nipple, inverting the bottle, and placing the nipple into the baby's mouth. The baby then sucks on the nipple to withdraw the liquid.

A typical nursing bottle is tightly sealed except for the small opening in the nipple. As the baby nurses, the liquid volume inside the bottle decreases and the air volume increases. However, ambient air is unable to enter the bottle so a partial vacuum is created. The partial vacuum, in turn, impedes the flow of liquid out the nipple and forces the baby to suck harder to withdraw the liquid. As the baby sucks harder on the nipple, ambient air inadvertently and inevitably enters the baby's mouth and stomach. Excessive air in the stomach and other parts of the alimentary canal causes colic, a condition characterized by abdominal discomfort and pain. See generally O. P. Mathew, *Science of Bottle Feeding,* The Journal of Pediatrics, October 1991, 511; and W. R. Treem, *Infant Colic,* Pediatric Clinics of North America, October 1994, 1121.

Many attempts have been made to provide a nursing bottle with an air vent to enable ambient air to enter the container during use. For example, Rodetick, U.S. Pat. No. 598,231, issued Feb. 1, 1898, discloses a nursing bottle having a U-shaped air tube. One end of the tube communicates with the top of the container interior while the other end communicates with the ambient air outside the bottle. When the bottle is inverted, liquid rises into the tube and impedes the flow of air into the interior of the container. If the bottle is placed upright quickly, the liquid in the tube does not have a chance to drain and it remains in the tube. When the bottle is again inverted, the liquid spills out the end of the tube which communicates with the ambient air. Other nursing bottles with air vents are disclosed in Van Cleave, U.S. Pat. No. 927,013, issued Jul. 6, 1909; Davenport, U.S. Pat. No. 1,441,623, issued Jan. 9, 1923; and Perry, U.S. Pat. No. 2,061,477, issued Nov. 17, 1936. None of these nursing bottles completely solves the problem of maintaining the interior of the bottle at atmospheric pressure while preventing leaks and spills. Accordingly, a demand still exists for a nursing bottle which prevents the formation of a partial vacuum inside the bottle during nursing and yet does not result in spills.

SUMMARY OF THE INVENTION

The general object of this invention is to provide an improved nursing bottle. A more particular object is to provide a nursing bottle which prevents the formation of a partial vacuum inside the bottle during nursing and yet does not result in spills. Another more particular object is to provide a nursing bottle which is easy to clean.

We have invented an improved nursing bottle of the type adapted to be filled with liquid and capped with a nipple. The interior of the nursing bottle remains at atmospheric pressure when the bottle is inverted during use. The nursing bottle comprises: (a) a vertical container having a mark defining a horizontal plane in the upper one-half of the container, the container being adapted to contain a quantity of liquid not exceeding the mark, the container having an air space above the liquid, and the container having a first, radially central opening at its top for the reception of a nipple; (b) a reservoir having a volume less than the volume of the container and being located such that substantially all its volume is above the mark in the container; (c) a vertical liquid conduit from a point near the bottom of the container to the bottom of the reservoir, the liquid conduit having a volume less than that of the reservoir so that, when the bottle is filled with liquid and inverted, the liquid from the liquid conduit only partially fills the reservoir and an air space remains in the reservoir; and (d) an air conduit from outside the bottle to a point in the reservoir where the air space exists when the bottle is filled with liquid and inverted; such that, when the nursing bottle is filled with liquid and fitted with a nipple, the liquid level in the container and in the liquid conduit are the same; and also such that, when the nursing bottle is inverted, the liquid from the liquid conduit flows into, and remains in, the reservoir for as long as the bottle is inverted and an open air passage is established through the air conduit-reservoir-liquid conduit to carry ambient air into the container and thereby maintain atmospheric pressure.

The interior of the nursing bottle of this invention remains at atmospheric pressure during use because a passageway remains open running from the ambient air; through the air conduit, the air space in the reservoir, and the liquid conduit; and to the air space inside the bottle. Accordingly, liquid continues to flow freely through the nipple and the baby nursing from the bottle is much less prone to swallow air and develop colic. The nursing bottle of this invention completely eliminates the possibility of leaks and spills when used properly and it is easy to clean.

BRIEF DESCRIPTION OF THE DRAWINGS

FIG. 2 is a sectional elevational view thereof.

FIG. 3 is a sectional view taken along plane 3—3 of FIG. 2.

FIG. 4 is a sectional view taken along plane 4—4 of FIG. 2.

FIG. 5 is a sectional view similar to that shown in FIG. 2, but with the nursing bottle in the inverted, feeding position.

DETAILED DESCRIPTION OF THE INVENTION

Figure 1:
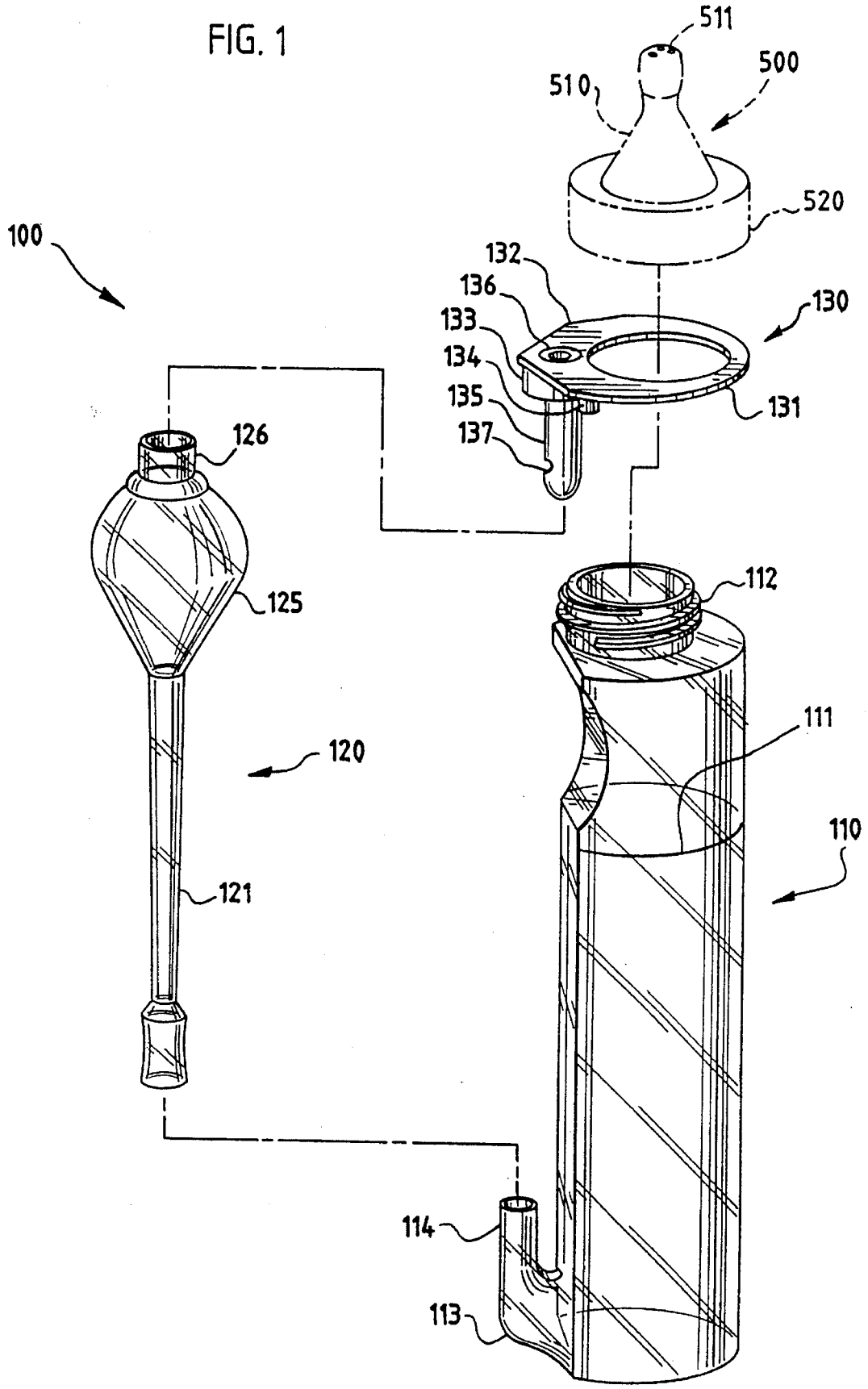
FIG. 1 is a perspective, exploded view of one embodiment of the nursing bottle of this invention.
Figure 7:
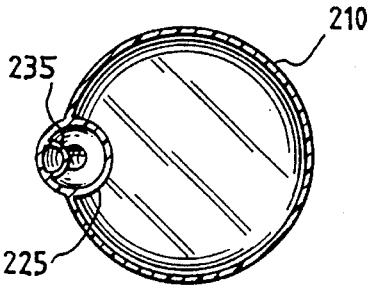
FIG. 7 is a sectional view taken along plane 7—7 of FIG. 6.
Figure 6:
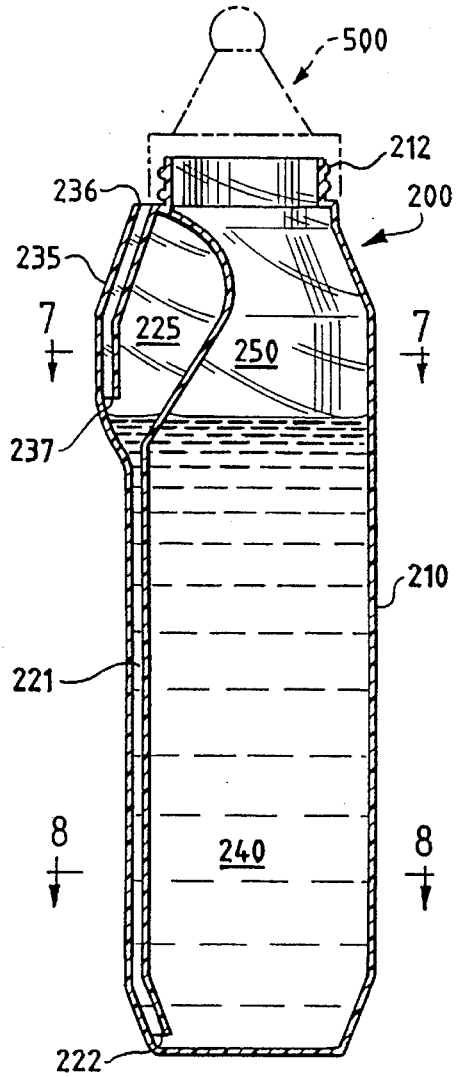
FIG. 6 is a sectional elevational view of a second embodiment of the nursing bottle of this invention.
Figure 8:
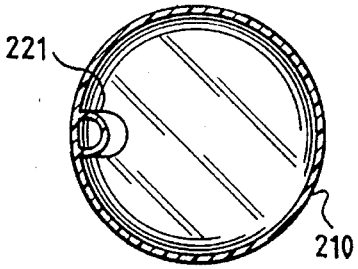
FIG. 8 is a sectional view taken along plane 8—8 of FIG. 6.

This invention is best understood by reference to the drawings. FIGS. 1–5 show the preferred embodiment of the nursing bottle 100 of this invention. The nursing bottle contains three components, a container 110, a liquid conduit-reservoir 120, and an air conduit-flange 130. Each of these three components is discussed below. The three components are separate and capable of easy disassembly and reassembly for ease of cleaning. A conventional nipple cap 500 is shown in phantom lines in FIGS. 1, 2, 5, 6, 9, 10 and 11. Although the nipple cap is not part of the nursing bottle of this invention, it is attached to the nursing bottle before use. The nipple cap includes a rubber portion 5 10 containing one or more small holes 511 in its tip through which the liquid flows when the baby sucks. The nipple cap also includes a collar portion 520 with internal threads for attaching the nipple cap to the bottle. The term "nipple" is used herein, as the context requires, to refer to the rubber portion of a nipple cap, to the entire nipple cap, and to any type of protruding member with a restricted opening designed to be held inside the mouth during use.

The container is adapted to hold a quantity of liquid 140 at its bottom and a quantity of air 150 at its top when in the vertical position. As will be explained, the liquid level in the container does not exceed a certain level. In FIG. 1, the maximum liquid level is shown by a line 111 permanently marked on the side of the container. This marked line is typically at or about the point of communication between the liquid conduit and the reservoir. An air space exists above the liquid. The container is typically cylindrical in shape, i.e., it has a height several times greater than its diameter. The container preferably has a diameter of about 3 to 8 cm so it can be held easily by the small hands of babies. If desired, detachable or permanent handles are added to the container. The container is preferably rounded throughout all or most of its circumference. As seen in FIGS. 3 and 4, the container of this embodiment is circular in cross-section throughout about 270° of its circumference. The other 90° is relatively flat. In contrast, other embodiments are circular or polygonal in cross-section for most of their heights.

The container has a threaded neck 112 adapted to receive a standard nipple cap. The neck is typically located at or about the radial center of the container (as viewed from the top). The container has an internal volume of about 0.05 to 1 liter and is constructed of a rigid or semi-rigid material such as glass or plastic. Suitable plastics include polypropylene and polyethylene (both low-density and high-density). The container preferably has some means for visually determining the liquid level. The container is preferably transparent or translucent so the liquid level can be viewed through the container. Alteratively, the container may be opaque and include a slit or series of ports through which the interior can be viewed. The container shown in the FIGS. 1–5 embodiment contains a protruding portion 113 at its bottom. Rising from, and communicating with, the protrusion is tube 114. The tube has a height of about 1–2 cm and a diameter of about 0.5 to 1 cm. As will be seen, the tube can be considered an extension of the liquid conduit when the components are assembled.

The second component of the preferred embodiment of the nursing bottle is the liquid conduit-reservoir. Although this component is molded as a single piece, it is best considered as two separate elements—a liquid conduit 121 and a reservoir 125. When the nursing bottle is assembled for use, the liquid conduit-reservoir fits onto the tube of the container by frictional fit. The frictional fit is sufficient to provide a seal and thereby prevent liquid from escaping. The liquid conduit begins at a point 122 near the bottom of the container, i.e., within about 1 to 5 cm of the bottom. This point is preferably in the container's air space when inverted, as best seen in FIG. 5. The other end 123 of the liquid conduit communicates with the bottom of the reservoir. It can be seen that, when the bottle is upright and contains liquid, liquid enters the conduit and reaches the same level as in the container. The primary purpose of the vertical liquid conduit is to provide a portion of a passage for ambient air into the container when the bottle is inverted and the liquid contents are being withdrawn through the nipple. Accordingly, the cross-sectional area of the liquid conduit need not be very large—an area of about 5 to 75 sq. mm is adequate. While not critical to this invention, the liquid conduit of the preferred embodiment is tapered inwardly from top to bottom. This taper facilitates the flow of liquid into the reservoir by minimizing capillary action when the bottle is inverted.

The reservoir is located such that substantially all its volume is above the maximum liquid level. In the preferred embodiment, the reservoir is adjacent to the air space at the top of the container. This location ensures that the reservoir is substantially free of liquid when the container is filled with liquid and in the upright, vertical position. The reservoir could be located above the air space, but this location is less desirable because it interferes with the baby's access to the nipple. The purpose of the reservoir is to retain any liquid from the liquid conduit and thereby prevent any liquid from spilling out the open end of the air conduit. The reservoir's volume is greater than the volume of the liquid conduit so that, when the bottle is inverted, it can hold whatever liquid is in the conduit and still contain an air space. There is no maximum size for the reservoir, but for practical reasons, the reservoir generally has a volume less than about one-fourth that of the container. The reservoir communicates with the liquid conduit at a point at or above the level of liquid in the container and conduit. If the liquid level is substantially above this point of communication, there is a danger that the reservoir may contain too much liquid when the bottle is inverted and, as a result, liquid could spill out the open end of the air conduit. The point of communication between the liquid conduit and reservoir is large enough and shaped to ensure that any liquid flowing down the liquid conduit when the bottle is inverted enters the reservoir. The shape of the reservoir is not critical, provided it tapers downwardly to the liquid conduit so that little, if any, liquid is retained in the reservoir when the nursing bottle is returned to the upright position. In the preferred embodiment, the reservoir is pear-shaped. However, other shapes, such as spherical and cylindrical, are also suitable. A threaded neck 126 is located on top of the reservoir for attaching it to the air conduit-flange.

The air conduit-flange is the third component of the nursing bottle. The flange portion 131 is adapted to fit over the threaded neck of the container. The flange is secured in position when the nipple cap is screwed tightly onto the threaded neck. The air conduit-flange has a protruding shoulder 132 which extends out and over the liquid conduit-reservoir. A member 133 with internal threads descends from the shoulder and is adapted to mate with the threaded neck on top of the reservoir. Two pegs 134 extend downwardly on either side of the member. When the nursing bottle is assembled, the pegs butt against the container, as best seen in FIG. 3. Although not essential, the pegs help secure the air conduit-flange and the liquid conduit-reservoir in position by restricting any lateral movement.

The air conduit 135 descends into the center of the reservoir. The air conduit has openings at each of its ends. The top opening 136 is located in the shoulder portion and communicates with ambient air. The bottom opening 137 is located near the bottom of the conduit and is located so that it is in the reservoir's air space when the bottle is inverted, as seen in FIG. 5. It can be seen that the bottom opening is preferably located on a radially-outward point of the air conduit to minimize the possibility of liquid entering the air conduit when the bottle is inverted.

The operation of the preferred embodiment of the nursing bottle of this invention can now be considered. The nursing bottle is first assembled. The liquid conduit-reservoir is attached to the air conduit-flange by screwing the threaded neck 126 into the descending member 133. These two components are then connected to the container by slipping the flange down and over the container's neck 112 while simultaneously guiding the liquid conduit onto the tube 114. The container is then partially filled with liquid. The liquid level should not substantially exceed the marked fill line, i.e., the point of communication between the liquid conduit and the reservoir. As previously discussed, if the liquid level substantially exceeds the point of communication, there is the danger of liquid spilling out the opening when the bottle is inverted. In FIG. 2, the liquid level is about 5 mm below the point of communication. The nipple is then secured to the container and the bottle is ready for use.

When the bottle is inverted, the liquid conduit-reservoir is maintained in a position facing upward, as seen in FIG. 5. This position ensures that: (1) all the liquid from the liquid conduit flows into the reservoir; (2) no additional liquid enters the conduit; and (3) ambient air is free to enter the interior of the container by flowing through the air conduit, the air space in the reservoir, and the liquid conduit. Thus, the interior of the bottle remains at atmospheric pressure during use and the baby nursing from the bottle is not forced to suck so hard that air is inadvertently swallowed. As a result, the chances of colic are greatly reduced.

Figure 9:
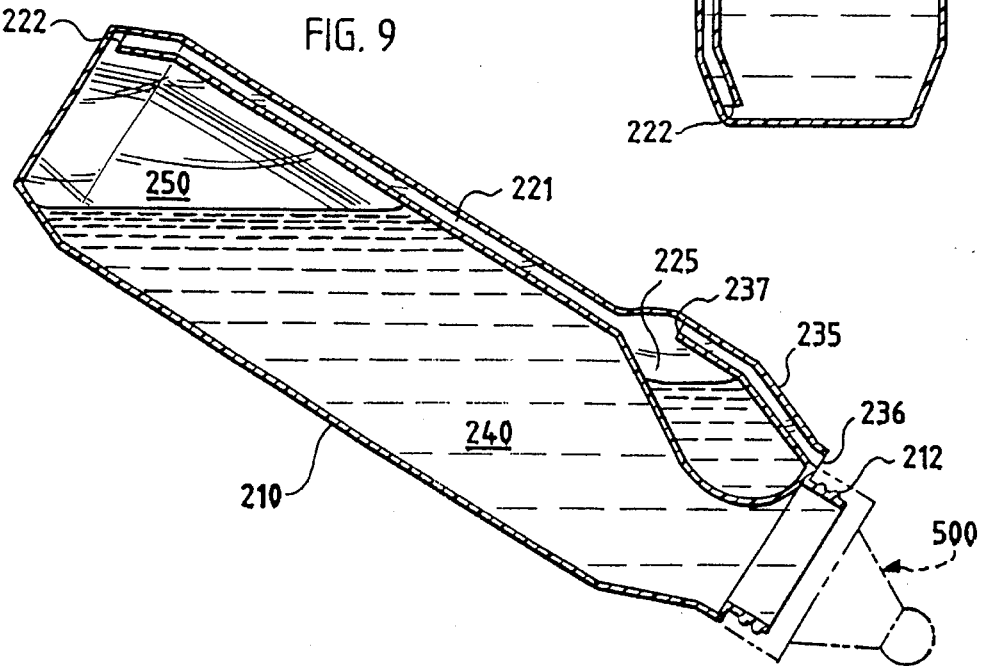
FIG. 9 is a sectional view similar to that shown in FIG. 6, but with the nursing bottle in the inverted, feeding position.

A second embodiment of the nursing bottle of this invention is shown in FIGS. 6–9. The bottle 200 contains the same components and functions the same as the preferred embodiment. In particular, the bottle 200 includes a container neck 212, a liquid conduit 221 which begins at a point 222 near the bottom of the container. An air conduit 235 descends into the center of the reservoir and has a bottom opening 237. The bottle 200 is adapted to hold a quantity of liquid 240 at its bottom and a quantity of air 250 at its top when in the vertical position. However, this embodiment differs from the preferred embodiment in two primary ways. First, this embodiment cannot be disassembled for cleaning. Second, the liquid conduit 221, the reservoir 225, and the air conduit 235 are all located inside the container 210. Referring to FIG. 9, it can be seen that it is very important that the liquid conduit-reservoir-air conduit face upward when the bottle is inverted so that no liquid flows into the air conduit. If the bottle were inverted incorrectly, liquid would flow down the air conduit and spill out through opening 236.

Figure 10:
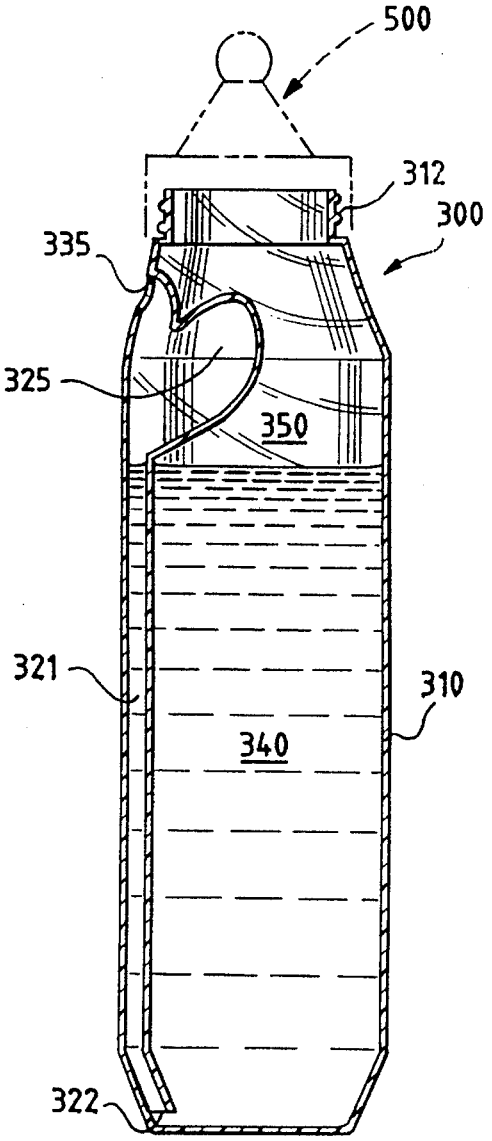
FIG. 10 is a sectional elevational view of a third embodiment of the nursing bottle of this invention.

FIG. 10 illustrates a third embodiment of the nursing bottle of this invention. The nursing bottle 300 is very similar to the bottle shown in FIGS. 6–9. In particular, the nursing bottle includes a container 310, a container neck 312, a liquid conduit 321 and a reservoir 325. The liquid conduit 321 begins at a point 322 near the bottom of the container. The bottle 300 is adapted to hold a quantity of liquid 340 at its bottom and a quantity of air 350 at its top when in the vertical position. The primary difference is that the air conduit 335 is simply an opening in the upper wall of the container.

Figure 11:
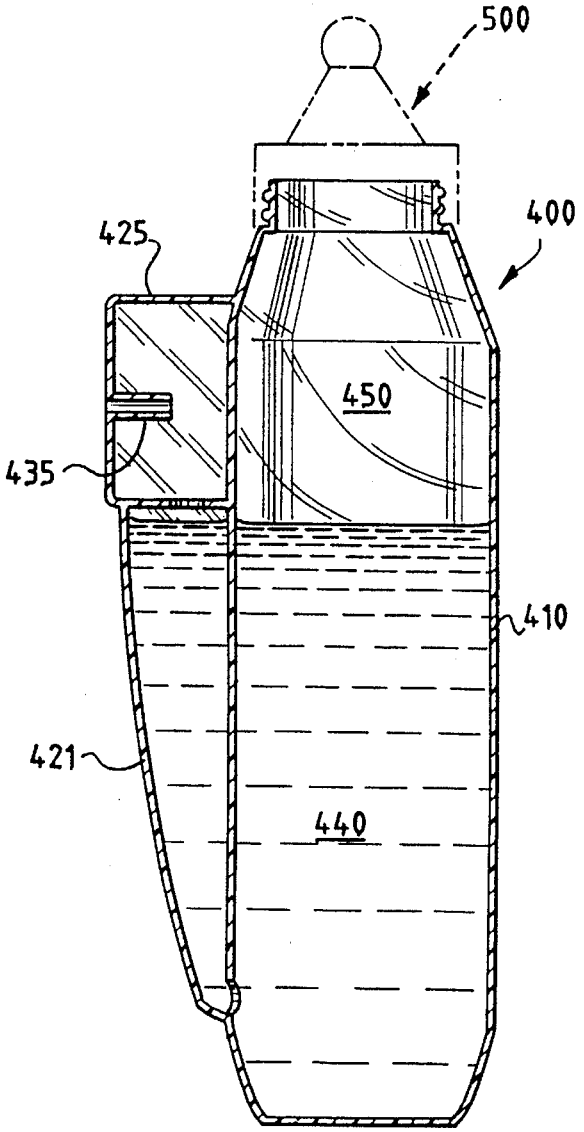
FIG. 11 is a sectional elevational view of a fourth embodiment of the nursing bottle of this invention.

A fourth embodiment of the nursing bottle of this invention is shown in FIG. 11. The nursing bottle 400 is adapted to hold a quantity of liquid 440 at its bottom and a quantity of air 450 at its top when in the vertical position. This bottle 400 differs from the second and third embodiments in that the liquid conduit 421, the reservoir 425, and the air conduit 435 are all outside the container 410. They are, however, connected to the container.

We claim:

1. A nursing bottle adapted to be filled with liquid and capped with a nipple, whose interior remains at atmospheric pressure when the bottle is inverted during use, the nursing bottle comprising:

(a) a vertical container having a mark defining a horizontal plane in the upper one-half of the container, the container being adapted to contain a quantity of liquid not exceeding the mark, the container having an air space above the liquid, and the container having a first, radially central opening at its top for the reception of a nipple;

(b) a reservoir having a volume less than the volume of the container and being located such that substantially all its volume is above the mark in the container;

(c) a vertical liquid conduit from a point near the bottom of the container to the bottom of the reservoir, the liquid conduit having a volume less than that of the reservoir so that, when the bottle is filled with liquid and inverted, the liquid from the liquid conduit only partially fills the reservoir and an air space remains in the reservoir; and (d) an air conduit from outside the bottle to a point in the reservoir where the air space exists when the bottle is filled with liquid and inverted; such that, when the nursing bottle is filled with liquid and fitted with a nipple, the liquid level in the container and in the liquid conduit are the same; and also such that, when the nursing bottle is inverted, the liquid from the liquid conduit flows into, and remains in, the reservoir for as long as the bottle is inverted and an open air passage is established through the air conduit-reservoir-liquid conduit to carry ambient air into the container and thereby maintain atmospheric pressure.

2. The nursing bottle of claim 1 wherein the reservoir is located adjacent the air space at the top of the container.

3. The nursing bottle of claim 2 wherein the liquid conduit and reservoir are located inside the container.

4. The nursing bottle of claim 2 wherein the liquid conduit and reservoir are located outside the container.

5. The nursing bottle of claim 2 wherein the liquid conduit and reservoir are detachable from the container.

6. A nursing bottle adapted to be filled with liquid and capped with a nipple, whose interior remains at atmospheric pressure when the bottle is inverted during use, the nursing bottle comprising:

(a) a container adapted to contain a quantity of liquid at its bottom and having an air space at its top, the container having a first, radially central opening at its top for the reception of a nipple;

(b) a reservoir located such that substantially all its volume is above the liquid level in the container;

(c) a vertical liquid conduit from a point near the bottom of the container to the bottom of the reservoir, the liquid conduit having a volume less than that of the reservoir so that, when the bottle is filled with liquid and inverted, the liquid from the liquid conduit only partially fills the reservoir and an air space remains in the reservoir; and (d) an air conduit from outside the bottle to a point in the reservoir where the air space exists when the bottle is filled with liquid and inverted; such that, when the nursing bottle is filled with liquid and fitted with a nipple, the liquid level in the container and in the liquid conduit are the same; and also such that, when the nursing bottle is inverted, the liquid from the liquid conduit flows into, and remains in, the reservoir for as long as the bottle is inverted and an open air passage is established through the air conduit-reservoir-liquid conduit to carry ambient air into the container and thereby maintain atmospheric pressure.

7. The nursing bottle of claim 6 wherein the reservoir is located adjacent the air space at the top of the container.

8. The nursing bottle of claim 7 wherein the liquid conduit and reservoir are located inside the container.

9. The nursing bottle of claim 7 wherein the liquid conduit and reservoir are located outside the container.

10. The nursing bottle of claim 9 wherein the liquid conduit and reservoir are detachable from the container.

* * * * *